US011619047B2

(12) United States Patent
Low

(10) Patent No.: US 11,619,047 B2
(45) Date of Patent: Apr. 4, 2023

(54) BRAIDED MULTI-AXIAL SLEEVE SYSTEM USED AS A STRUCTURAL REINFORCEMENT FOR CONCRETE COLUMNS AND METHOD FOR CONSTRUCTING CONCRETE COLUMNS

(71) Applicant: Raymond Alan Low, Fresno, CA (US)

(72) Inventor: Raymond Alan Low, Fresno, CA (US)

( * ) Notice: Subject to any disclaimer, the term of this patent is extended or adjusted under 35 U.S.C. 154(b) by 0 days.

(21) Appl. No.: 17/836,226

(22) Filed: Jun. 9, 2022

(65) Prior Publication Data

US 2022/0298792 A1 Sep. 22, 2022

Related U.S. Application Data

(63) Continuation-in-part of application No. 16/996,905, filed on Aug. 19, 2020, now Pat. No. 11,408,176.

(60) Provisional application No. 62/888,854, filed on Aug. 19, 2019.

(51) Int. Cl.
*E04C 5/06* (2006.01)
*E04C 3/34* (2006.01)

(52) U.S. Cl.
CPC ..... *E04C 5/0618* (2013.01); *E04C 3/34* (2013.01)

(58) Field of Classification Search
CPC ..... E04C 5/0618; E04C 3/34; E04C 5/0613; E04C 5/0622; E04C 5/0627; E04C 5/0609; E04C 5/07; E04C 5/012; E04C 3/36; E04C 3/30; E04G 13/021; E04G 9/08

See application file for complete search history.

(56) References Cited

U.S. PATENT DOCUMENTS 2,295,420 A * 9/1942 Moore ..... B65H 81/08 52/249
4,694,622 A * 9/1987 Richard ..... B28B 3/00 52/223.5
5,218,810 A * 6/1993 Isley, Jr. ..... E04G 23/0218 52/249
5,599,599 A * 2/1997 Mirmiran ..... E04C 5/07 428/36.3

(Continued)

FOREIGN PATENT DOCUMENTS

CA 2429927 A1 * 11/2004 ..... E04C 5/0609
CH 691608 A5 * 8/2001 ..... E04C 5/07

(Continued)

*Primary Examiner* — Babajide A Demuren

(57) ABSTRACT

A column reinforced with two reinforcement sleeves provides a low-cost, simpler method to form strong concrete columns for constructing buildings and other structures. The column includes a multi-axially braided reinforcement outer sleeve and an inner sleeve, which together provide sufficient structural support so that rebar can be eliminated from the column. Elimination of rebar saves cost and prevents the possibility of rebar oxidation which might otherwise undermine the structural integrity of the column and lead to catastrophic structural failure. The reinforcement sleeve is lightweight, easy to transport, and can be greatly reduced in size to facilitate transportation. The reinforcement sleeve and construction method can be utilized in many implementations and can be particularly useful for constructing buildings or other structures in geographic areas that are subject to earthquakes and/or corrosion, and where low cost is important.

20 Claims, 13 Drawing Sheets

(56) References Cited

U.S. PATENT DOCUMENTS

| | | | | |
|---|---|---|---|---|
| 6,295,782 | B1 * | 10/2001 | Fyfe | E04C 5/07 52/359 |
| 9,086,183 | B2 * | 7/2015 | Fyfe | F16L 55/1653 |
| 9,267,286 | B2 * | 2/2016 | Kim | E04C 5/0604 |
| 2005/0229532 | A1 * | 10/2005 | Teng | E04C 3/29 52/834 |
| 2015/0159387 | A1 * | 6/2015 | Chou | B29C 70/32 249/48 |

FOREIGN PATENT DOCUMENTS

| | | | | |
|---|---|---|---|---|
| CN | 100564804 | C * | 12/2009 | |
| CN | 102877465 | A * | 1/2013 | |
| FR | 2985748 | A1 * | 7/2013 | E04C 3/36 |
| KR | 100819169 | B1 * | 4/2008 | |

* cited by examiner

BRAIDED MULTI-AXIAL SLEEVE SYSTEM USED AS A STRUCTURAL REINFORCEMENT FOR CONCRETE COLUMNS AND METHOD FOR CONSTRUCTING CONCRETE COLUMNS

CROSS-REFERENCE TO RELATED APPLICATIONS—CLAIM OF PRIORITY

Reference is made, and priority is hereby claimed to co-pending U.S. patent application Ser. No. 16/996,905, filed Aug. 20, 2020, entitled MULTI-AXIALLY BRAIDED REINFORCEMENT SLEEVE FOR CONCRETE COLUMNS AND METHOD FOR CONSTRUCTING CONCRETE COLUMNS, and U.S. Provisional Patent Application No. 62/888,854, filed Aug. 19, 2019, entitled MULTI-AXIALLY BRAIDED REINFORCEMENT SLEEVE FOR CONCRETE COLUMNS AND METHOD FOR CONSTRUCTING CONCRETE COLUMNS, all of which are incorporated herein by reference.

BACKGROUND

Technical Field

The invention relates to materials, components, and construction techniques for forming vertical support structures using concrete aggregate.

Description of Related Art

Fundamental and critical elements of building construction are the support structures for the building. Vertical support structures hold up beams, roofs, and other parts of a building. One type of vertical support structure is a column, which is a strong, typically cylindrical structure that can, for example, extend from floor to ceiling inside a structure, or outside, from the ground up to the first, second or subsequent floors. Each column is designed with the strength to hold the weight of what is above it, which can be very substantial. To construct vertical support structures, conventional construction techniques utilize concrete aggregate in combination with reinforcement materials such as rebar.

Concrete aggregate is commonly used in the construction industry. Concrete aggregate includes cement in various combinations with water, sand, gravel, and other materials that help add to its strength in the particular conditions in which the concrete will be employed. For ease of reference, the term "concrete" as used herein includes any of these combinations of cement and other materials that form a concrete aggregate.

Concrete has many advantages, including great compressive strength, good longevity with little maintenance, and it is relatively impervious to weather. However, there are some disadvantages to using concrete to construct columns. One disadvantage is concrete's low tensile strength. For example, if a column were to be made solely of concrete, it would crack and break relatively easily when subjected to tensile axial forces. To compensate for the low tensile strength, an internal structure is commonly utilized. For example, an internal structure may include one or more rebar rods situated vertically inside the column to improve the concrete column's tensile strength.

Under normal stress loads and environmental conditions, rebar rods as internal structures function well with concrete and provide good support for concrete columns. However, under the extreme conditions of fire, corrosion, or earthquakes, the steel reinforcement bars destroy the very members they were designed to save. For example, corroding steel reinforcement alone costs every country 3 to 4% of its GDP in maintenance, repair, or replacement. Likewise, when steel reinforcement is directly exposed to fire, the rebar will rapidly rise in temperature and cause the loss of the concrete cover due to spalling, which will significantly reduce the load-carrying capacity of the concrete member. When concrete columns are laterally loaded, as in an earthquake, the vertical rebar is placed in the precarious position of alternating between being placed under compression, then under tension, and then back again. When under tension, the vertical rebar elongates axially, breaking its bond with the concrete and allowing the concrete to crack. As the column bends back on the return swing, the rebar is now under compression, with all of the column's gravitational load placed on it. The vertical rebar now expands, cracking the concrete even more, spalling the concrete cover, eventually buckling, and forcefully ejecting the concrete core from its reinforcement cage, causing the column to fail, which in turn can bring down an entire building, or at least a portion of it.

Another disadvantage of rebar-reinforced concrete columns is their construction cost, which can be substantial. To construct a concrete column, workers first install the rebar cage into a suitable foundation, then build formwork around the rebar cage that defines the column, and then build a frame that holds the column in place. Then the concrete is poured, and after it dries, the frame and formwork are removed and eventually discarded at the end of the project. Although sometimes formwork can be reused during the scope of a project, the ability to reuse it is limited. For example, if the formwork is unique, it can't be reused and will be discarded. Still another disadvantage is that rebar is heavy and can be expensive to transport, especially for pre-formed structures.

The conventional multi-step column construction technique described above using rebar, formwork, and frames, adds significant labor and material costs to the total construction cost of a building. Unfortunately, it also creates several additional construction and practical problems such as concrete honeycombing in the formwork; cold joints; bug holes; cracking concrete during form removal; over-vibration which can cause formwork blowout; formwork failures; improper construction due to workers' lack of attention to formwork details; possible removal of formwork too early; the extensive time needed to plan for formwork, stripping time requirements and storage requirements; determining the capacity of equipment available to handle form sections and materials; determining the capacity of mixing and placing equipment; determining suitability for reuse of forms as affected by stripping time; considering the relative merits of job-built, shop-built and ready-made forms; and weather-related problems (such as rain or snow) that can adversely affect the formwork.

It would be an advantage to provide an improved system and method for constructing concrete columns that have a lower cost, and better resistance against extreme events such as corrosion, fire, and earthquake damage. It would also be an advantage if the construction of the columns could be easier, quicker, and safer.

SUMMARY

A concrete support structure including a multi-axially braided reinforcement sleeve is described for constructing support elements for buildings and other structures. A reinforced concrete column and a method for constructing concrete columns are described, which can provide a low-cost, simpler method to form strong concrete columns for buildings and other structures that is quicker and safer.

Multiple embodiments are described. In one embodiment a structurally reinforced concrete column for constructing buildings comprises a substantially solid concrete core consisting essentially of concrete with an outer multi-axially braided reinforcement sleeve embedded in the concrete on the perimeter of the core. This outer reinforcement sleeve has a flexible, multi-axially braided configuration and an inner reinforcement sleeve embedded in the concrete, situated concentrically within the outer reinforcement sleeve. Together, the outer and inner reinforcement sleeves provide flexible reinforcement for the concrete column. The outer reinforcement sleeve may have a biaxially or triaxially braided configuration in which a plurality of strands is oriented parallel and some being oblique with the central axis of the column. The inner reinforcement sleeve may include a plurality of strands that are oriented substantially horizontally, transverse to the central axis. The outer and inner reinforcement sleeves have a weave that is substantially flexible and does not contain polymer resins that would otherwise interfere with sleeve flexibility. The plurality of strands in the outer and inner reinforcement sleeves may be substantially inelastic, and flexibility in the sleeves is provided by the weave of the strands in the sleeve. This concrete column reinforced with the inner and outer sleeves is strong, and therefore, the rebar that is normally used for axial support can be eliminated.

The multi-axially braided reinforcement sleeve can be manufactured inexpensively, and the disclosed construction method eliminates several steps from conventional construction methods, thus reducing the overall cost of constructing a concrete column. Advantageously, the rebar that normally is embedded axially in the column can be eliminated, along with the frame and formwork. Elimination of the rebar further reduces cost, and the multi-axially braided reinforcement sleeve provides tensile axial support to the column as well as stronger resistance to earthquake damage and further eliminates the possibility of rebar corrosion which would otherwise undermine the structural integrity of the column.

As an additional advantage, the multi-axially braided reinforcement sleeve is relatively lightweight (especially compared to rebar), easy to transport, and it can be reduced in size to facilitate transportation, in some embodiments, even collapsed. The size reduction allows the reinforcement sleeve to be transported without special requirements, thereby reducing cost.

Construction using the multi-axially braided reinforcement sleeve has several advantages. One advantage is the time and cost savings resulting from the elimination of formwork, installation, and removal. With no formwork, there is much less chance of damaging the concrete column or cracking the concrete, which could otherwise happen when the formwork is removed. Another advantage of eliminating the formwork is that there is no honeycombing in the concrete, which can be caused by air trapped between the formwork and the concrete, and no bug holes to repair.

Using a pre-manufactured multi-axially braided reinforcement sleeve eliminates the construction problems related to unskilled labor such as improperly detailing the rebar cage, using insufficient ties, or failing to give appropriate attention to formwork.

Another advantage is improved safety. Because the multi-axially braided reinforcement sleeve is positioned before the concrete is poured, remains in place after the concrete is poured, and doesn't require formwork, the often-fatal accidents related to formwork failures that can (and have) happened can be prevented. For example, eliminating formwork prevents accidents that might otherwise happen if formwork is removed too early (before the concrete is adequately cured and not structurally sound). It would also prevent accidents that could otherwise happen when the formwork itself fails for reasons such as poor design, reusing formwork that has lost its integrity even if it passes visual inspection or just human error.

The multi-axially braided reinforcement sleeve can be made in many different configurations, which can be designed and/or selected to meet the requirements of a large variety of construction jobs. To choose the appropriate configuration for a particular construction job, one consideration is the tensile strength of the sleeve. Generally, a sleeve is selected to have a weave pattern and be made of a material that can at least hold the hydrostatic pressure caused by the weight of the concrete poured into it. Thus, because the sleeve has already been designed to withstand the hydrostatic pressures of the liquid concrete, this eliminates blowouts and other problems that might be caused if old formwork were used, or if the formwork becomes over-vibrated which can cause separation of concrete mixtures, increased pressures, and subsequent blowouts in the formwork.

Construction using the reinforcement sleeve also eliminates the need to clean, inspect, transport, and store formwork, which would otherwise consume a tremendous amount of time and add costs during the construction project.

The reinforcement sleeve has a multi-axially braided configuration which provides a weaved pattern that defines a plurality of gaps. The weaved pattern and material allow cement paste to flow into and around the fibers of the sleeve, sufficiently that the sleeve becomes bonded to the concrete column while holding the coarse concrete aggregate inside the sleeve. Advantageously, the flow of cement paste (and maybe some sand or smaller particles) through the gaps expels unwanted air and fills the spaces within the sleeve, so that the sleeve column can become almost uniformly filled with concrete. A more uniform fill provides a stronger column structure substantially free of air pockets that might otherwise undermine the column's strength.

The multi-axially weaved structure is particularly useful because it defines a type of selective locking mechanism. The weave is close (tight) enough that it contains the concrete within the sleeve. In some embodiments, some gaps can have a size to allow some of the sand and cement paste to flow through the gaps in the sleeve, and this flow-through material can then be spread around the exterior of the sleeve, and after drying, becomes the cover for the column itself. In other words, in some implementations, the gaps may be large enough to allow cement paste to flow through to the outside, which can then be smoothed to create a substantially smooth external surface that can provide a better appearance.

To support the multi-axially braided reinforcement sleeve during construction, a support structure can be utilized. In one embodiment, the workers can attach the sleeve to a top structure and a bottom structure, and (optionally) insert a PVC pipe in the opening to help hold the sleeve in place. The PVC pipe also defines where the column is to be. Then concrete is poured in, the (optional) PVC pipe is removed, and if some of the cement paste seeps through gaps in the mesh, the paste on the outer perimeter can be smoothed and let dry.

Another advantage is that rebar can be eliminated from the column in many embodiments. Not only does rebar add to cost, but it is believed that the properties of the rebar itself can contribute to the destruction of the column during extreme events such as fire, corrosion, or an earthquake. The elimination of rebar prevents these problems, and the multi-axially braided reinforcement sleeve allows the column to retain most of its strength during and after these extreme events.

BRIEF DESCRIPTION OF THE DRAWINGS

For a more complete understanding of this invention, reference is now made to the following detailed description of the embodiments as illustrated in the accompanying drawing, wherein:

FIG. 3A shows a circular cross-section, FIG. 3B shows a rectangular cross-section, FIG. 3C shows a flat rectangular ribbon cross-section, and FIG. 3D shows a thin rectangular band cross-section.

FIG. 8A shows the beginning flow of cement paste out through the gaps in the sleeve, FIG. 8B shows the sleeve strands covered by concrete paste after flowing into the gaps 140, and FIG. 8C shows the concrete layer formed after the cement paste dries.

DETAILED DESCRIPTION

As used herein, the term "concrete", or "concrete aggregate" includes cement in various combinations with water, sand, gravel, rocks, and other materials that help to add to its strength in the particular conditions in which the concrete will be employed. For ease of reference, the term "concrete" as used herein includes any of these combinations of cement and other materials.

For purposes herein, concrete can be defined as including a cement paste, a coarse aggregate, and other materials such as sand. The term "coarse aggregate" includes larger solids, like rock and gravel. The term "cement paste" includes water mixed with cement. When fresh, cement paste typically flows in a semi-liquid manner.

A concrete support structure including a multi-axially braided reinforcement sleeve is described for constructing support elements for buildings and other structures. The support elements are described in the context of columns, similar principles can be applied to create other support structures such as beams.

(1) Multi-Axial Braided Reinforcement Sleeve

Figure 1:
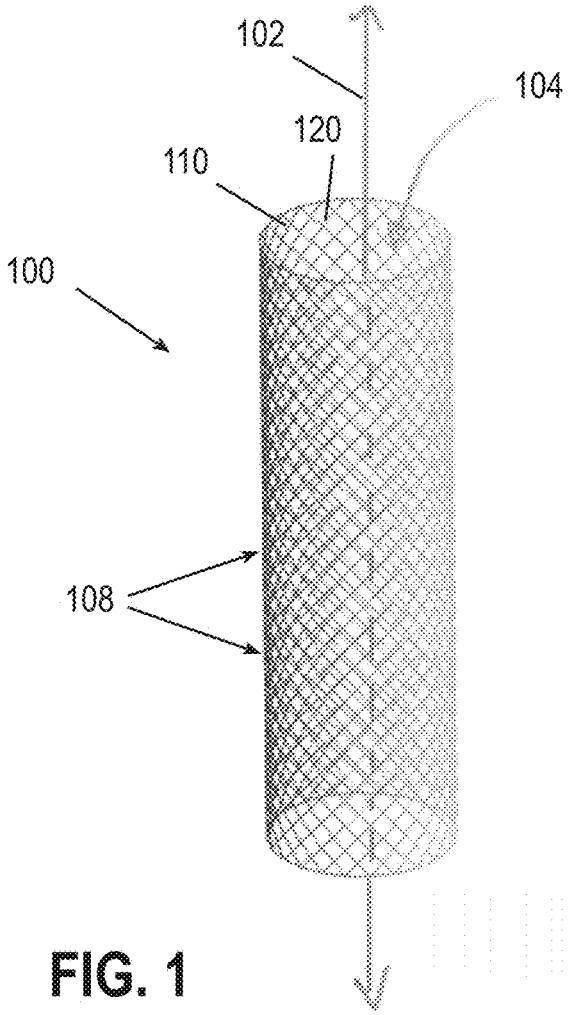
FIG. 1 is a perspective view of a multi-axially braided reinforcement sleeve in an extended configuration.
Figure 2:
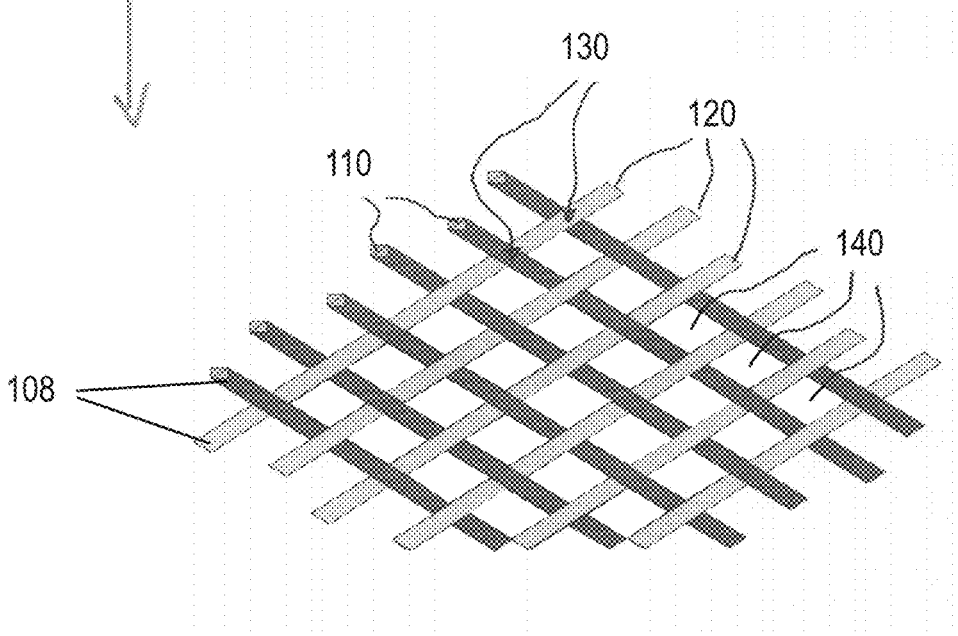
FIG. 2 is a perspective close-up view of a section of a biaxially braided reinforcement sleeve.

Reference is first made to FIGS. 1 and 2. FIG. 1 is a perspective view of a multi-axially braided reinforcement sleeve 100 in an extended configuration, and FIG. 2 is a perspective closeup view of a cut-out portion of the biaxially braided reinforcement sleeve 100. As shown in FIGS. 1 and 2, the multi-axially braided sleeve 100 for use in constructing a concrete column includes a plurality of strands 108 including at least a first plurality 110 of strands and a second plurality 120 of strands axially braided around a central axis 102 into a tubular braided structure that defines the sleeve 100 and a defines a central opening 104 axially through the tubular structure. Particularly, the first plurality of strands 110 are axially braided following a first rotation and the second plurality of strands 120 are axially braided following a second rotation counter-rotating to the first rotation. Thus, the first plurality of strands crosses the second plurality of strands at a plurality of crossings 130, and the crossed pattern of the first and second plurality defines a plurality of gaps 140.

The gaps 140 may or may not allow some cement paste to flow through to the outside while holding the concrete inside the sleeve. Advantageously, the flow of some cement paste (and maybe some sand or smaller particles) through the gaps expels unwanted air and fills the spaces within the sleeve, so that the sleeve column becomes approximately uniformly filled with concrete. A more uniform fill provides a stronger column structure substantially free of air pockets that might otherwise undermine the column's strength. The multi-axially weaved structure is particularly useful because it defines a type of selective locking mechanism.

In some embodiments, such as the embodiment illustrated in FIG. 1 and FIG. 2, the braided reinforcement sleeve 100 has a biaxial weave pattern (the braid follows two counter-rotating axes) that defines the plurality of gaps 140 between the strands 108, and the plurality of strand crossings 130 where the strands cross. In other embodiments, such as will be described with reference to FIGS. 12 and 13, the weave pattern can be triaxial, in which the first and second plurality of strands cross as in the biaxial configuration, and a third plurality of strands are oriented substantially parallel with the axis of the column. In still other embodiments, such as will be described with reference to FIGS. 14 and 15, the triaxial sleeve 1200 combines with an inner sleeve 1400 that has a plurality of substantially unidirectional strands oriented transverse to the central axis of the sleeve, The material used in the strands 108 can be any material such as metal, plastic, nylon, ceramics, aramid, carbon fiber, glass fiber, or any natural or synthetic material of suitable strength and durability that has the appropriate characteristics for the desired end application. Generally, the strands are relatively inelastic.

Figure 3A:
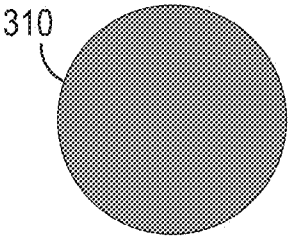
FIGS. 3A, 3B, 3C, and 3D are cross-sectional views of several different strand configurations.
Figure 3B:
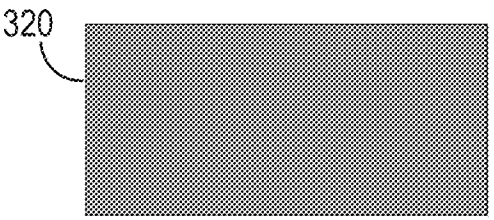
Figure 3C:
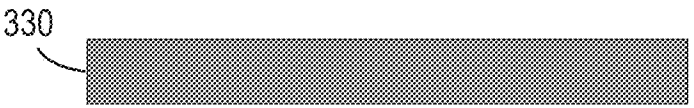
Figure 3D:
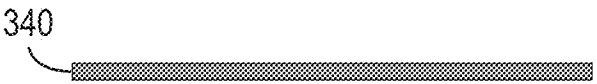

FIGS. 3A, 3B, 3C, and 3D are example configurations for each single strand 108, illustrating that the strands can have different forms and configurations. The strands can have any suitable configuration. FIG. 3A shows a circular cross-section 310 like a wire, FIG. 3B shows a rectangular cross-section 320, FIG. 3C shows a flat rectangular ribbon cross-section 330, and FIG. 3D shows a thin rectangular band cross-section 340. To choose the appropriate configuration for a particular construction job, one consideration is the strength and flexibility of the sleeve. Generally, a sleeve is selected to have a weave pattern, a strand configuration, and be made of a material that can at least hold the hydrostatic pressure caused by the weight of the concrete poured into it. Thus, because the sleeve has already been designed to withstand the hydrostatic pressures of the liquid concrete, this eliminates blowouts and other problems that might be caused if old formwork were to be used, or if the formwork was over-vibrated which can otherwise cause separation of concrete mixtures, increased hydrostatic pressures, and subsequent blowouts in the formwork.

Although typically the materials and strand configurations will be consistent throughout the sleeve, in some embodiments some strands may comprise different materials and/or different configurations. For example, in the same sleeve, some strands may be nylon and others may be aramid, some strands may have a wire configuration and others may have a band configuration. The materials and configuration of the strands are chosen based on their properties to create the desired strength, flexibility, and weave pattern of the end product sleeve.

Many different types of strands can be used in the multi-axially braided reinforcement sleeve. Examples of these strands include the following:

1) ⅛ inch circular wire

2) Bands that are as much as 2 to 3 inches across yet thin enough to be weaved or braided into the sleeve 3) The strands may be plastic, with a rectangular cross-section about ½ inch wide and 1/32 inch thick 4) The strands could be metal bands ½ an inch to 3 inches wide that are weaved into a sleeve, similar to the metal bands that hold lumber together for transport 5) The strands could be plastic bands of various sizes weaved into sleeves, similar to the plastic bands used to hold boxes together when mailed, and 6) The material of the strands could be nylon, aramid, glass fiber, carbon fiber, or any synthetic or natural material of suitable strength and durability that can be weaved into reinforcement sleeves.

Generally, the material and configuration of the strands are chosen to be relatively inelastic compared to the sleeve. For example, individual strands made of metal may not bend or stretch easily (i.e., they may be relatively inelastic). However, the overall braided sleeve will be substantially flexible due to its braided pattern, even if the individual strands are inelastic.

As shown in FIG. 2, the multi-axial braiding 100 of the strands 108 provides a weaved pattern that defines the plurality of crossings 130 and may or may not have some gaps 140. The gaps 140 may or may not allow some cement paste to flow through to the outside while holding the concrete aggregate inside the sleeve.

The weave pattern depends upon several factors such as design requirements, the properties of the concrete mixture, and the outside temperature. Different types of concrete may require a different weave pattern, angle of weave, and type of reinforcement bands/ribbons. The type of concrete can change, and the compression stress of concrete can vary anywhere from less than 3,000 psi to over 10,000 psi, the water/cement ratio can vary depending on weather conditions, the size of the pour, and the type of cement that is used. All these factors can be considered when selecting the appropriate sleeve for a particular installation.

(2) Fabricating the Multi-Axially Braided Reinforcement Sleeve

Fabricating the multi-axially braided reinforcement sleeve can be accomplished using any suitable method. Many braiding methods are known in the art, and the particular method chosen for forming the braided tubular structure will depend upon the requirements of any particular implementation. A few examples of methods and apparatus that can braid strands to create a tubular configuration are shown in US Patent Publication US20150299916, U.S. Pat. Nos. 7,311,031, 5,257,571, and 5,099,744.

As described above, the configuration of the strands 108, given the material, must be thick enough or of such density to substantially contain the concrete in the weaved pattern. The strands may be relatively inelastic for strength, and the braid pattern provides flexibility to the reinforcement sleeve.

In one embodiment, the braided sleeve has a biaxial weave pattern in which the first set of strands are wrapped around the central axis in a first rotation, and the second set of strands are wrapped around the central axis in a second, opposite rotation. In other embodiments, the braided sleeve may have a triaxial weave pattern, or a combination of an inner sleeve (comprised of a biaxial weave nearly lateral to the length of the column) and an outer sleeve (comprised of a triaxial weave pattern along the length of the column) working together, or other suitable weave patterns.

Many different materials and configurations can be implemented. Typically, the braided structure will be formed with a uniform braid pattern throughout its length. Still, many variations are possible with a uniform braid pattern, for example, the weaved pattern could include a finer mesh that would hold in place a stronger but looser weave of a different material. For example, the weaved pattern could include a finer nylon mesh that holds heavier aramid belts that are weaved into sleeves.

In some embodiments, it may be useful to vary the braid pattern in certain areas, so that the braid is nonuniform along its length. For example, one embodiment may create additional strength in certain portions of the sleeve by a tighter weave, or in other embodiments, more flexibility in the braid can be provided by using a looser weave.

Note that the flexibility of the reinforcement sleeve would be adversely affected by the use of resins/polymers on the sleeve as the resins would harden and impair flexibility. Therefore, any use of resins/polymers on the sleeve, or any material that would prevent the sleeve from flexing, should be avoided.

(3) Method of Column Construction

To recap the conventional construction method discussed above in the prior art section, in conventional concrete column methods, workers first install vertically-extending rebar rods into a suitable foundation, then build formwork around the rebar to define the column, and then build a frame that holds it all in place. Then the concrete is poured in, and after it dries, the frame and formwork are removed. This conventional multi-step construction technique has several disadvantages, such as adding significant labor and material costs to the total construction cost of a building, creating safety issues, and lengthening the construction time. Furthermore, in extreme events such as a fire, corrosion, or an earthquake, the columns may fail, and the rebar itself contributes to the failure of the column.

The method described herein simplifies construction by eliminating conventional formwork and replacing it with a pre-manufactured multi-axially braided sleeve. The ceiling holds the sleeve in place on its upper end, and the floor provides a foundation at the lower end. Conventional axial rebar and ties are optional and may be eliminated; for some uses, rebar may be eliminated entirely. For other uses, if extra strength is required, some amount of rebar may be desirable and placed within the multi-axially braided sleeve.

Figure 4:
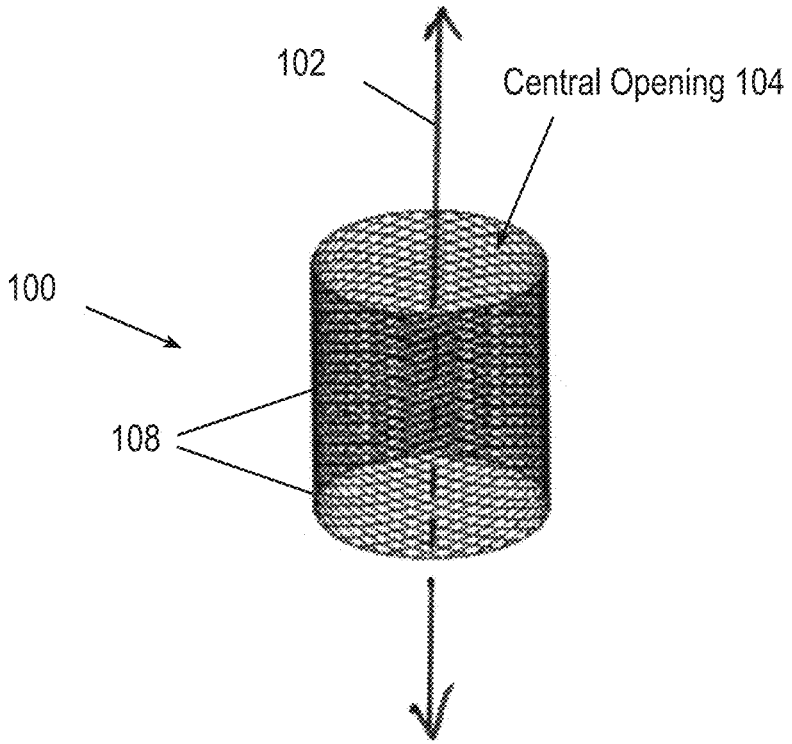
FIG. 4 is a perspective view of the multi-axially braided reinforcement sleeve compressed (packed down) to a reduced size that may be used for transportation.

FIG. 4 is a perspective view of the reinforcement sleeve 100 compressed (packed down) to a reduced size for transportation. The reinforcement sleeve 100 can be flattened and rolled on a reel, or folded. In FIG. 4 the sleeve is shown compressed along its axis 102 and can be folded, but more generally the sleeve can be packed down in any manner suitable to the materials and configuration of the strands 108.

Figure 5:
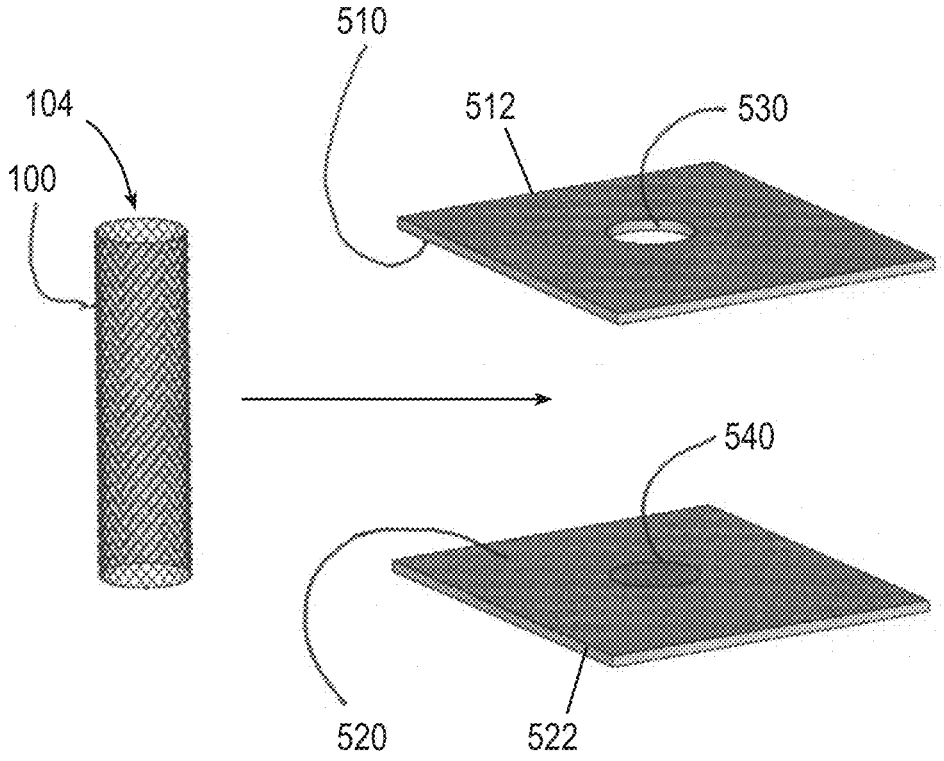
FIG. 5 is a perspective view of an installation location, including an upper and lower surface defined on upper and lower structures, and a sleeve.

FIG. 5 is a perspective view of a location prepared for installing a concrete column with the reinforcement sleeve 100. The installation location includes an upper surface 510 shown on a section of an upper structure 512 (e.g., a ceiling) and a lower surface 520 shown on a section of a lower structure 522 (e.g., a floor) to which the reinforcement sleeve 100 is affixed.

One way to install a column is to pour the columns remotely (as modules) and then move the poured columns to the installation location. Such pre-casted forms could also be pultruded through dies and cut to length. Pultrusion is a continuous process for manufacture with an approximate constant cross-section by pulling the material, as opposed to extrusion which pushes the material.

Another way is to attach the respective ends of the reinforcement sleeve 100 to the upper surface 510 and lower surface 520 using any suitable attachment method, such as tying the reinforcement sleeve 100 into the existing rebar found in the floor and ceiling concrete slabs.

In some embodiments, the joint at the end of the column may be a straight cylinder (see. FIG. 11) whereas in other embodiments (see FIGS. 6, 7, and 10) the reinforcement sleeve may flare at the end like a cone of increasing diameter, or a vase-like structure that expands out from near the end of the column to the adjacent surface or foundation. The expanding joint support would also increase strength and ductility in the column-to-beam and column slab connections.

If joint support tying into the existing rebar in the floor and ceiling concrete slabs is not used, the concrete columns could be poured at another location, transported, lifted into place, and attached with grouted dowels.

In the embodiment of FIG. 5, an opening 530 in the upper surface 510 is provided to allow the concrete to be poured into the central top opening as is done with conventional formwork. Generally, the central opening 104 of the reinforcement sleeve 100 must be accessible in some manner, so that concrete can be poured in. If there are circumstances where the opening at the top of the column is not available, spreaders could be used to create an opening in the side of the reinforcement sleeve through which concrete can be poured, and then the spreaders can be removed, and the sleeve reassembled or mended.

Figure 6:
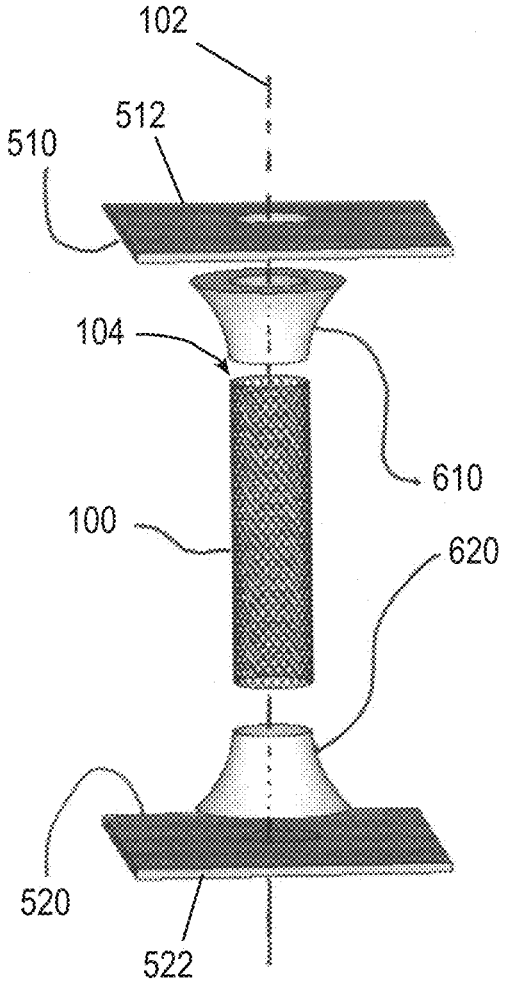
FIG. 6 is an expanded perspective view illustrating how the multi-axially braided reinforcement sleeve is aligned and attached to the upper and lower surfaces in one embodiment.

FIG. 6 is an expanded perspective view of the reinforcement sleeve 100 positioned between the upper surface 510 and lower surface 520, including an upper joint support 610 and a lower joint support 620 in the form of a concave flaring cone shape at the respective connections with the upper surface 510 and the lower surface 520.

In some methods, a pipe such as a PVC pipe (not shown) can be inserted into the central opening 104. The outer diameter of the PVC pipe fits within the central opening 104 and preferably is adjacent to the inner diameter of the installed reinforcement sleeve 100. Thus, the PVC pipe would be nested inside the reinforcement sleeve 100, and the cylindrical structure of the PVC pipe holds the reinforcement sleeve in place while the concrete is being poured.

Figure 7:
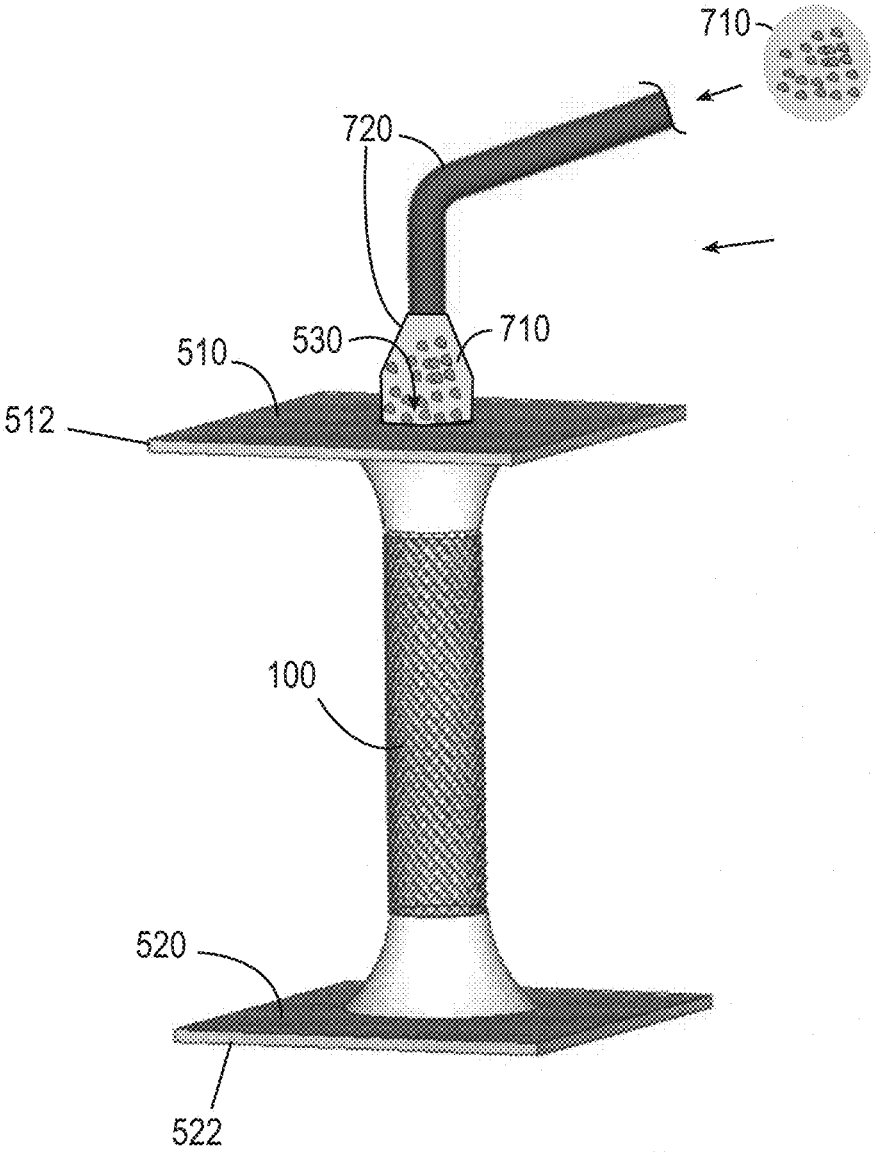
FIG. 7 is a perspective view of concrete being poured through a tube into the central opening of the reinforcement sleeve.

FIG. 7 is a perspective view of concrete 710 being poured via a delivery tube 720 and through the opening 530 in the upper surface 510 into the central opening of the reinforcement sleeve 100. Generally, the concrete is poured into the central opening 104 until it is filled.

In the embodiment of FIGS. 5, 6, and 7, an opening 530 in the upper surface 510 is provided to allow the concrete 710 to be poured through and into the central opening 100 as is done with conventional formwork. Generally, the central opening 104 of the multi-axially braided reinforcement sleeve 100 must be accessible in some manner, so that the concrete 710 can be poured in. If in an alternative embodiment there are circumstances where the opening 530 at the top of the column is not available, spreaders could be used to create an opening in the side of the reinforcement sleeve 100 through which concrete can be poured and the spreaders removed and the sleeve 100 reassembled or mended.

In the embodiment where the PVC pipe is utilized to maintain the columnar structure while the concrete is being poured, the PVC pipe within the opening is first filled with concrete. Then, the PVC pipe is removed, more concrete is added to fill the space vacated by the PVC pipe, and to fill the opening, and the concrete is allowed to flow to the reinforcement sleeve.

Figure 8A:
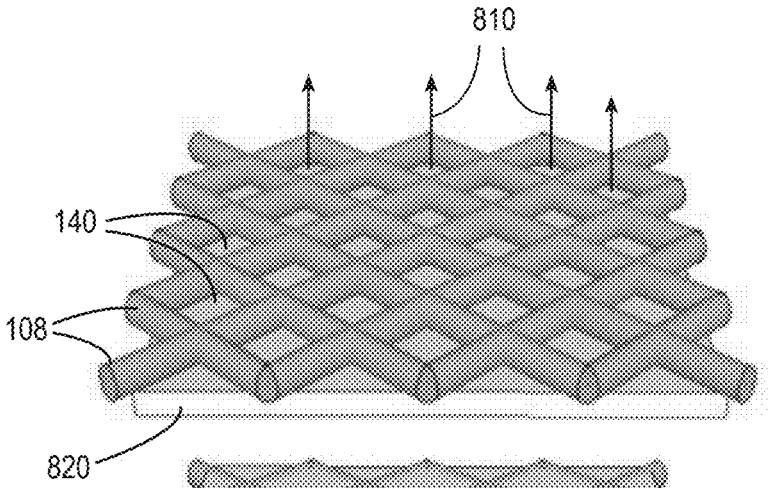
FIGS. 8A, 8B, and 8C are close-up perspective views of a section of the outside of the column during and after construction.
Figure 8B:
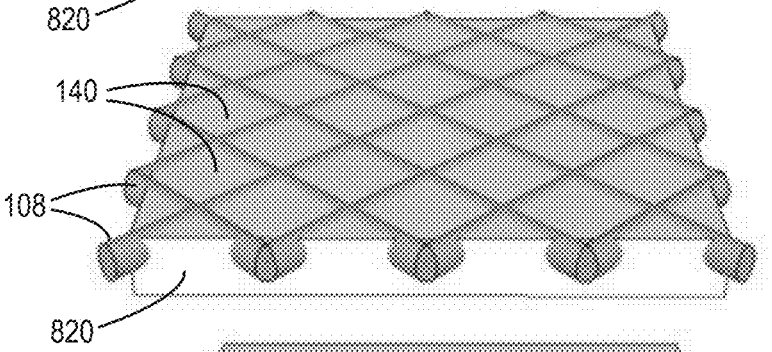
Figure 8C:
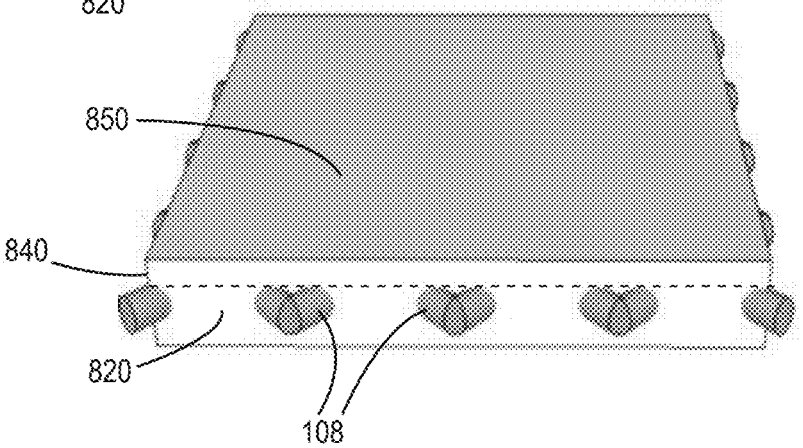

FIGS. 8A, 8B, and 8C are close-up perspective cut-out views of sections of the outside of the column, illustrating the flow of concrete through the multi-axially braided reinforcement sleeve 100 during construction. A similar flow goes through an inner sleeve which will be described later with reference to FIG. 14 et seq.

FIG. 8A is a section 801 that illustrates a beginning flow 810 of cement paste 820 out through the gaps 140 between the strands 108 in the reinforcement sleeve. FIG. 8B is a section 802 after the concrete paste 820 has flowed into the gaps 140, and substantially covers the strands 108. At this point, the strands 108 have become substantially embedded within the concrete paste 820. In some embodiments, the cement paste 820 can now be allowed to dry.

In other embodiments, as shown in FIG. 8C, the concrete paste 820 can flow out farther from the gaps 140, to create an additional covering for the reinforcement sleeve, which can be smoothed to provide a cleaner appearance. FIG. 8C shows section 803 of a concrete layer 840 that is formed after the cement paste 820 has flowed through the gaps and dries outside the strands 108 of the sleeve. As discussed above, the reinforcement sleeve 100 defines gaps 140 that may or may not be large enough to allow a flow of the semi-liquid cement paste and small particles such as sand, but small enough to prevent the outward flow of coarse aggregate (e.g., gravel, rocks). As the semi-liquid cement paste 820 flows through the gaps 140, it reaches the outer surface of the reinforcement sleeve, forms the layer 840, and then dries enough to be spread by workers into a smooth outer surface 850.

Figure 9:
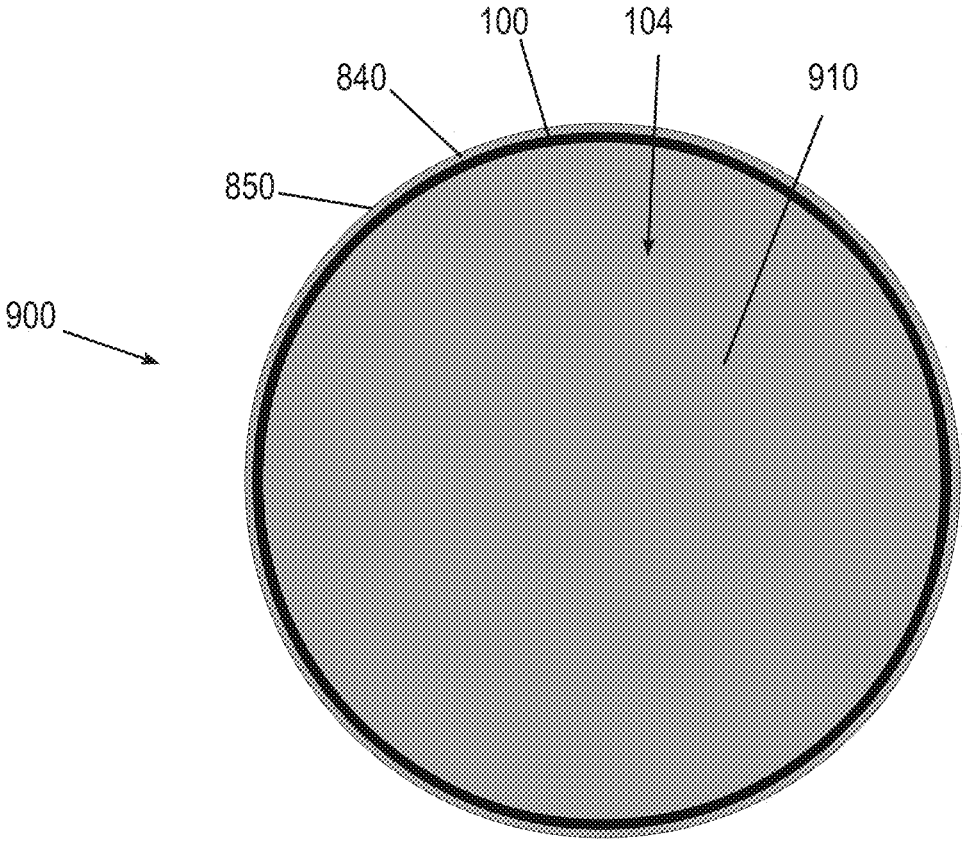
FIG. 9 is a cross-sectional view of a completed column including the multi-axially braided reinforcement sleeve with concrete inside and a concrete layer outside.

FIG. 9 is a cross-sectional view of one embodiment of a completed column 900 such as column 1000 (FIG. 10) or column 1100 (FIG. 11). The central opening of the reinforcement sleeve (104, FIG. 1) is now filled with concrete, including coarse aggregate and cement paste, that provides a concrete core 910. The reinforcement sleeve 100 is now embedded in concrete around the outside perimeter of the concrete core 910.

FIG. 9 also illustrates an embodiment that includes the outer smoothed surface 850 of the column, and adjacent to the surface 850, the outer layer 840 of dried cement paste and small particles enclose the reinforcement sleeve 100.

As shown in FIG. 9, the multi-axially braided reinforcement sleeve 100 contains the concrete within the core 910 and supports the column 900 transversely. Yet during extreme earthquake events, the reinforcement sleeve 100 doesn't go under compression and therefore does not expand to cause any damage to the column. Instead, if the column drifts due to earthquake forces, the reinforcement sleeve may elongate and tighten around the column whenever the column needs lateral support.

Figure 10:
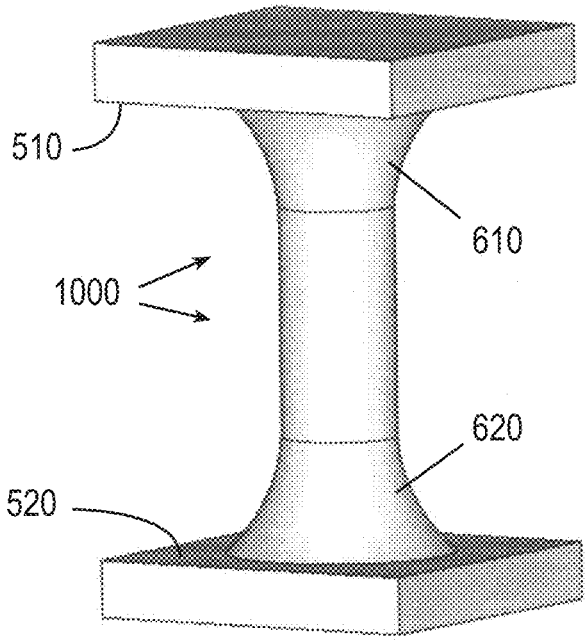
FIG. 10 is a perspective view of the finished column after the outside surface has been smoothed.
Figure 11:
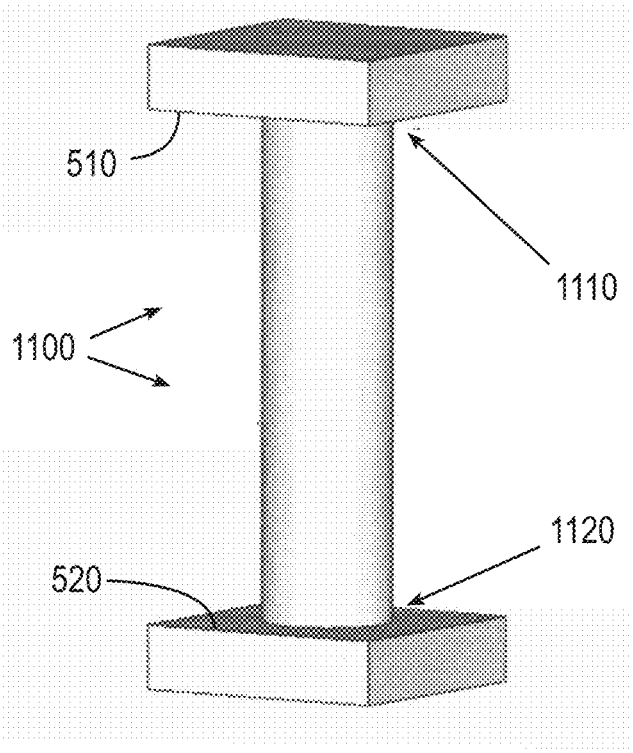
FIG. 11 is a perspective view of a finished column in an alternative implementation in which a straight cylindrical joint support is utilized.

FIG. 10 is a perspective view of one embodiment of a finished column 1000 after the outside surface has been smoothed including the concave section. In this embodiment, upper joint support 610 and the lower joint support 620 have the form of a concave flaring cone shape at their respective connections with the upper surface 510 and the lower surface 520.

FIG. 11 is a perspective view of another embodiment of a finished column 1100 in which a straight cylindrical joint support configuration is used for the upper joint 1110 and a lower joint 1120, instead of the concave flared cone configuration shown in the embodiment of FIG. 10.

Although an implementation described herein utilizes the multi-axially braided reinforcement sleeve 100 to form a column such as column 1000 or column 1100, it can also be used to create other support structures such as a beam.

(4) Triaxial Sleeve Embodiment

Figure 12:
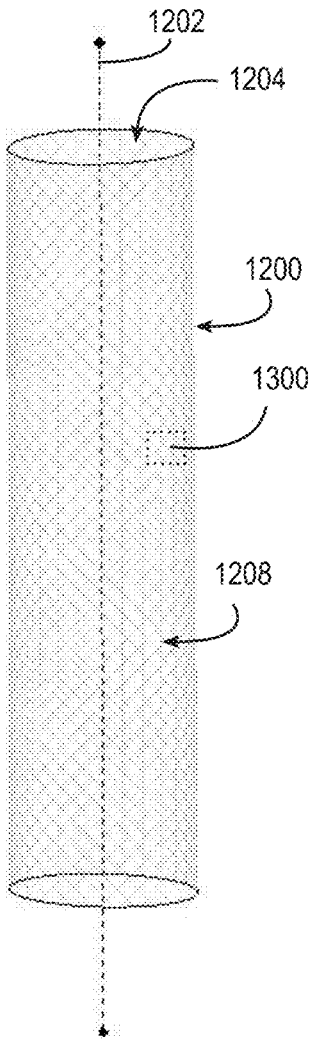
FIG. 12 is a perspective view of a triaxially-braided tubular reinforcement sleeve.

FIG. 12 is a perspective view of a triaxially-braided tubular reinforcement sleeve 1200 in an extended configuration. As shown in FIG. 12, the tubular structure of the sleeve 1200 defines a central axis 1202 and a central opening 1204, and the sleeve 1200 includes a plurality of strands 1208 weaved into a triaxial configuration around the central axis 1202.

Figure 13:
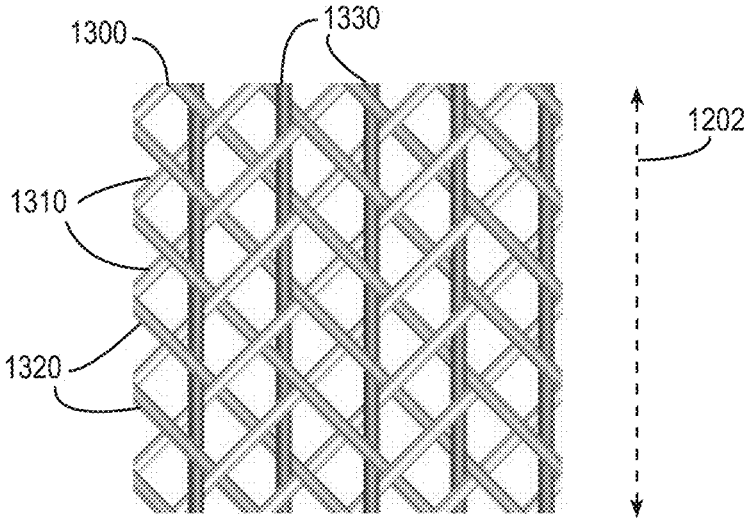
FIG. 13 is a side view of a section of the triaxially braided reinforcement sleeve, illustrating a triaxial weave.

FIG. 13 is a side view of a cut-out section 1300 of the triaxially braided reinforcement sleeve 1200, illustrating the triaxial weave. As can be seen from this section 1300, the plurality of strands 1208 includes a first plurality of strands 1310 crossed by a second plurality of strands 1320, (similar to the biaxial weave) and in addition, the strands 1208 include a third plurality of strands 1330 aligned substantially parallel to the central axis 1202.

(5) Inner and Outer Reinforcement Sleeves

Figure 14:
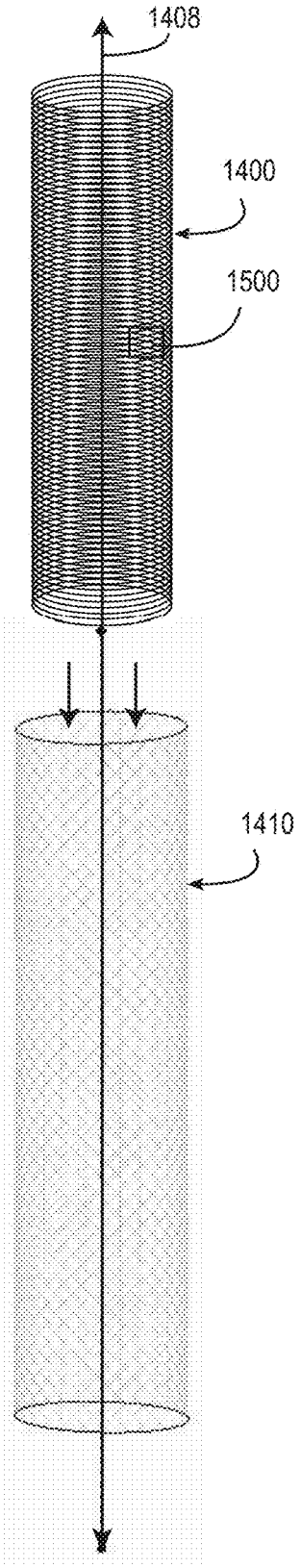
FIG. 14 is a perspective view of an inner reinforcement sleeve and an outer reinforcement sleeve, that can be implemented into a concrete column.

FIG. 14 is a perspective view of a sleeve arrangement that includes an inner reinforcement sleeve 1400 and an outer reinforcement sleeve 1410. The inner sleeve 1400 has a size to fit concentrically within an outer sleeve 1410. The inner reinforcement sleeve 1400 has a plurality of strands that are oriented in a substantially horizontal direction (i.e., the strands wrap horizontally, transverse to a central axis 1408 defined by the inner and outer sleeves. The outer sleeve 1410 comprises a multi-axially braided sleeve such as the triaxially-braided sleeve 1200 or the biaxially-braided sleeve 100.

The inner reinforcement sleeve 1400 may be manufactured in a tubular configuration as shown in FIG. 1. In alternative embodiments, the inner reinforcement sleeve 1400 can be formed by wrapping a sheet of unidirectional material so that the direction of the material's strength is substantially horizontal. The inner reinforcement sleeve 1400 concentrically fits within the outer reinforcement sleeve 1400. In some embodiments, the inner and outer reinforcement sleeves may be connected by any suitable means.

Figure 15:
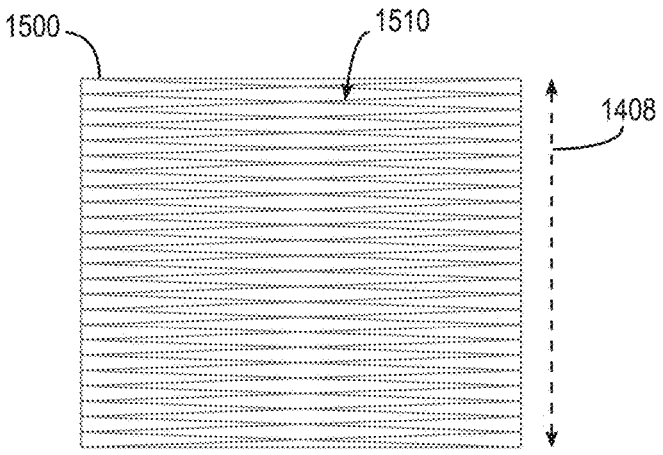
FIG. 15 is a side view of a section of the inner reinforcement sleeve, illustrating a substantially horizontal weave.

FIG. 15 is a side view of a cut-out section 1500 of the inner reinforcement sleeve 1400, illustrating a substantially horizontal weave 1510 in one embodiment. Generally, the substantially horizontal weave may be provided in any suitable configuration such as a biaxial weave with very small-angle crossings, a spiral, hoops with vertical connections, or any other weave that provides substantial strength in the transverse direction.

Figure 16:
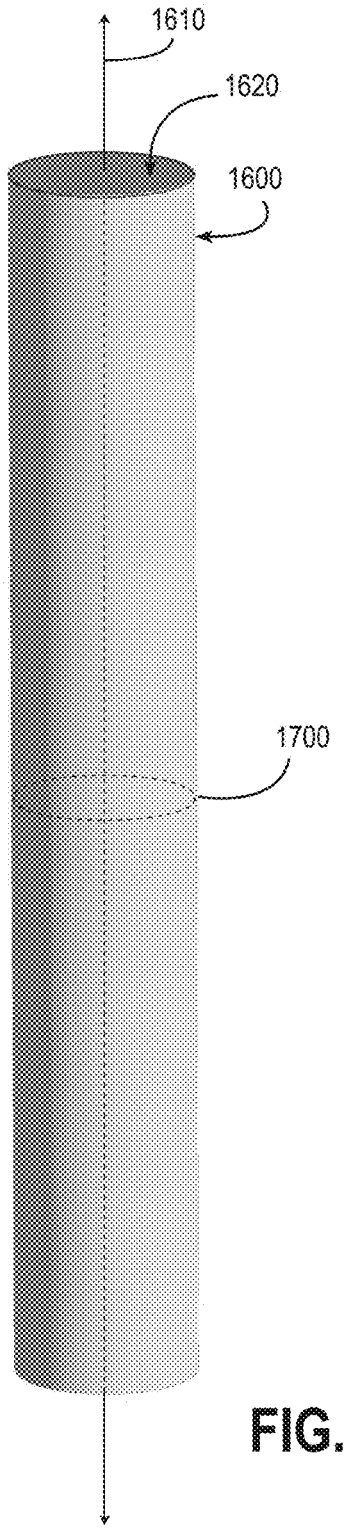
FIG. 16 is a perspective view of a completed column that includes an inner sleeve and an outer sleeve to reinforce the column.

FIG. 16 is a perspective view of a completed column 1600, which has a cylindrical shape that defines a central axis 1610 and a central core 1620. As illustrated by the cross-section 1700 shown in FIG. 17, column 1600 includes the inner reinforcement sleeve 1400, and the outer reinforcement sleeve 1410 around its perimeter.

Figure 17:
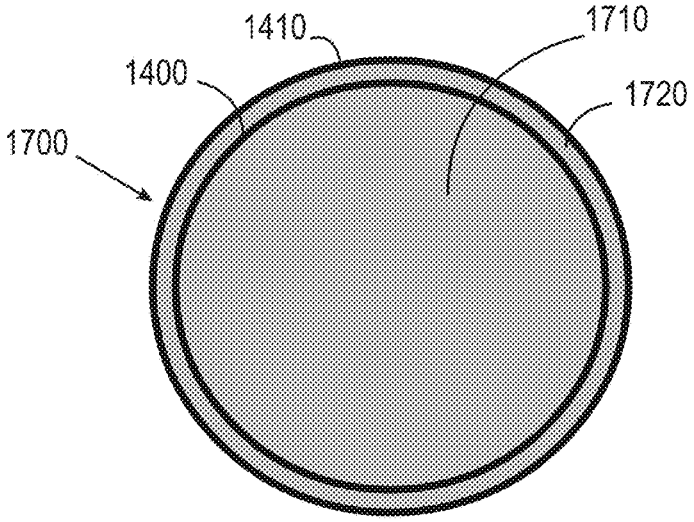
FIG. 17 is a cross-sectional view of one embodiment of the completed column that includes an inner sleeve and an outer sleeve embedded in concrete along the column perimeter.

FIG. 17 is a cross-sectional view of one embodiment of the completed column 1600 including the inner reinforcement sleeve 1400 and the outer reinforcement sleeve 1410 embedded in the column 1600. The central core 1620 is now filled with concrete, including coarse aggregate and cement paste, that provides a concrete core 1620 within the reinforcement sleeves consisting essentially of concrete. The outer reinforcement sleeve 1410 is now embedded in concrete on the outside perimeter of the concrete core 1620, and the inner reinforcement sleeve 1400 is situated concentrically within the outer sleeve 1410.

In the FIG. 17 embodiment, the concrete has flowed through the inner reinforcement sleeve 1400 and into the outer reinforcement sleeve 1400, so that both the inner and outer reinforcement sleeves are embedded in the concrete. For purposes of illustration, the inner and outer reinforcement sleeves are shown separated by a middle concrete layer 1720. In some embodiments, the inner and outer reinforcement sleeves may be adjacent to each other and in those embodiments, the middle concrete layer 1720 may be small or non-existent. In FIG. 17, the outer reinforcement sleeve 1410 is shown embedded in the concrete, but unlike the column shown in FIG. 9, FIG. 17 does not illustrate the smooth outer layer 840 of dried cement paste and small particles. For some implementations, the smooth outer concrete layer 840 may not be desired or needed. However, other implementations of column 1600 may utilize the outer cement layer 840 to enclose the outer reinforcement sleeve 1410 and provide a substantially smooth outer surface.

As shown in FIG. 17, the inner and outer reinforcement sleeves work together to contain the concrete within the core 1620 and support column 1700 transversely. Yet during extreme earthquake events, the inner and outer reinforcement sleeves do not go under compression and therefore do not expand to cause any damage to the column. Instead, if the column drifts due to earthquake forces, the reinforcement sleeves may elongate and even tighten around the column whenever the column needs lateral support.

As an alternative construction technique, rather than forming the concrete column in place, the column could be formed elsewhere and then transported to the installation. For example, the column could be formed on the job site or in a nearby location, and then lifted into position to be installed.

In many embodiments, the step of installing rebar axially along the length of the column may be eliminated entirely to save cost and also to prevent destruction during an earthquake. However, for some purposes, rebar may still be useful. For example, a length of rebar can be installed extending into either or both ends of the column to prevent the ends of the columns from sliding or provide additional structural support depending on the demands placed on the column.

Terms and phrases used in this document, and variations thereof, unless otherwise expressly stated, should be construed as open-ended as opposed to limiting. As examples of the foregoing: the term "including" should be read as meaning "including, without limitation" or the like; the term "example" is used to provide examples of instances of the item in a discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements, or components of the disclosed method and apparatus may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described with the aid of block diagrams, flow charts, and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A structurally reinforced concrete column for constructing buildings, comprising:

a substantially solid concrete core consisting essentially of concrete;

an outer multi-axially braided reinforcement sleeve embedded in the concrete on the perimeter of the core, the outer reinforcement sleeve having a flexible, multi-axially braided configuration including at least a first plurality of strands and a second plurality of strands axially braided into a tubular braided structure; and an inner reinforcement sleeve embedded in the concrete situated concentrically within the outer reinforcement sleeve, the inner reinforcement sleeve including a plurality of strands;

wherein the outer and inner reinforcement sleeves provide reinforcement for the concrete column.

2. The structurally reinforced concrete column of claim 1 wherein the braided configuration of the outer reinforcement sleeve has a biaxially braided configuration in which the first plurality of strands follow a first rotation and the second plurality of strands follow a second rotation chosen so that the first plurality of strands crosses the second plurality of strands so that the braided configuration provides a flexible outer sleeve.

3. The structurally reinforced concrete column of claim 2 wherein the column defines a central axis, and the braided configuration of the outer reinforcement sleeve has a triaxial configuration including a third plurality of strands oriented substantially parallel with the central axis of the column.

4. The structurally reinforced concrete column of claim 1 wherein the inner reinforcement sleeve includes a plurality of strands that are oriented substantially transverse to the central axis.

5. The concrete column of claim 1, wherein the inner and outer reinforcement sleeves have a substantially flexible weave and do not contain polymer resins.

6. The structurally reinforced concrete column of claim 1 wherein the plurality of strands in the outer and inner reinforcement sleeves are substantially inelastic.

7. The structurally reinforced concrete column of claim 6 wherein the strand material in the plurality of strands of the inner and outer reinforcement sleeves comprises at least one of steel, metal, plastic, nylon, aramid, ceramics, glass fiber, and carbon fiber or any natural or synthetic material of suitable strength and durability.

8. The structural concrete column of claim 1, wherein the multi-axially braided configuration defines a plurality of gaps, and further comprising a concrete outer layer formed with semi-liquid cement paste that has been added to the structure or has flowed through the gaps in the multi-axially braided reinforcement sleeve wherein the concrete outer layer extends outside of the outer sleeve to fully enclose the outer sleeve.

9. The concrete column of claim 8, wherein the concrete outer layer has a substantially smooth outer surface.

10. The concrete column of claim 1, wherein the concrete core does not include rebar for axial support along its length.

11. A structurally reinforced concrete column for constructing buildings, comprising:

a substantially solid concrete core consisting essentially of concrete;

an outer reinforcement sleeve embedded in the concrete on the perimeter of the core, the outer reinforcement sleeve having a flexible, triaxially braided configuration including a first plurality of strands, a second plurality of strands, and a third plurality of strands axially braided into a tubular braided structure, wherein the third plurality of strands are oriented substantially parallel with the central axis of the column; and an inner reinforcement sleeve embedded in the concrete situated concentrically within the outer reinforcement sleeve, the inner reinforcement sleeve including a plurality of strands oriented substantially transverse to the central axis of the column;

wherein the outer and inner reinforcement sleeves provide flexible reinforcement for the concrete column.

12. The structurally reinforced concrete column of claim 11 wherein the plurality of strands in the outer and inner reinforcement sleeves are substantially inelastic.

13. The structurally reinforced concrete column of claim 11 wherein the strand material comprises at least one of steel, metal, plastic, nylon, aramid, ceramics, glass fiber, and carbon fiber or any natural or synthetic material of suitable strength and durability.

14. The concrete column of claim 11, wherein the inner and outer reinforcement sleeves have a flexible weave, does not contain polymer resins, and thereby remains flexible.

15. The concrete column of claim 11, wherein the concrete core does not include rebar for axial support along its length.

16. The structural concrete column of claim 11, wherein the braided configuration defines a plurality of gaps, and further comprising a concrete outer layer formed with semi-liquid cement paste that has flowed through the gaps in the braided reinforcement sleeve, wherein the concrete outer layer extends outside of the outer reinforcement sleeve to fully enclose the sleeve, and wherein the concrete outer layer has a substantially smooth outer surface.

17. A structurally reinforced concrete column for building construction, comprising:

a substantially solid concrete core consisting essentially of concrete;

a flexible, multi-axially braided outer reinforcement sleeve embedded in the concrete on the perimeter of the core to reinforce the column, the flexible multi-axially braided reinforcement sleeve including at least a first plurality of substantially inelastic strands and a second plurality of substantially inelastic strands axially braided into a braided structure, the first plurality of strands axially braided following a first rotation and the second plurality of strands axially braided following a second rotation chosen so that the first plurality crosses the second plurality of strands and provides a weaved pattern that provides a flexible sleeve; and an inner reinforcement sleeve embedded in the concrete situated concentrically within the outer reinforcement sleeve, the inner reinforcement sleeve including a plurality of substantially inelastic strands oriented substantially transverse to the central axis of the column.

18. The concrete column of claim 17, wherein, and the inner and outer reinforcement sleeves have a substantially flexible weave and do not contain polymer resins.

19. The concrete column of claim 17, wherein the concrete core does not include rebar for axial support along its length.

20. The structural concrete column of claim 17, wherein the braided configuration defines a plurality of gaps, and further comprising a concrete outer layer formed with semi-liquid cement paste that has flowed through the gaps in the braided sleeve, wherein the concrete outer layer extends outside of the outer reinforcement sleeve to fully enclose the sleeve, and wherein the concrete outer layer has a substantially smooth outer surface.

* * * * *